US006128999A

United States Patent [19]

Sepp et al.

[11] Patent Number: 6,128,999

[45] Date of Patent: Oct. 10, 2000

[54] ARRANGEMENT FOR PROTECTION OF ACTIVE ARMOR

[75] Inventors: Gunther Sepp, Ottobrunn; Franz Tessun, Unterschleissheim, both of Germany

[73] Assignee: Messerschmitt-Bolkow_Blohm GmbH, Germany

[21] Appl. No.: 07/314,705

[22] Filed: Feb. 21, 1989

[30] Foreign Application Priority Data

Feb. 18, 1988 [DE] Germany ..... 38 04 991

[51] Int. Cl.[7] ..... E41H 5/007

[52] U.S. Cl. ..... 89/36.17; 89/36.08

[58] Field of Search ..... 89/36.08, 36.12, 89/36.17, 36.07, 36.01; 114/12, 13, 14, 15, 16, 270

[56] References Cited

U.S. PATENT DOCUMENTS

| | | | |
|---|---|---|---|
| 43,377 | 6/1864 | Pagenstecher | 114/13 |
| 1,182,725 | 5/1916 | Wallace | 114/14 |
| 1,416,950 | 5/1922 | Fay | 114/270 |
| 2,514,488 | 7/1950 | Hale et al. | 89/36.08 |
| 4,156,033 | 5/1979 | Bienz | 427/8 |
| 4,270,613 | 6/1981 | Spector et al. | 137/87 |
| 4,398,446 | 8/1983 | Pagano et al. | 89/36.08 |
| 4,609,034 | 9/1986 | Kosson et al. | 89/36.01 |
| 4,732,181 | 3/1988 | Sollander et al. | 89/36.01 |
| 4,801,113 | 1/1989 | Engelhardt | 89/36.01 |

FOREIGN PATENT DOCUMENTS

| | | | |
|---|---|---|---|
| 78741 | 10/1919 | Austria | 114/14 |
| 1329023 | 4/1963 | France | 89/36.08 |
| 274513 | 5/1914 | Germany | 114/16 |
| 2848072 | 5/1980 | Germany | 89/36.01 |
| 802231 | 10/1958 | United Kingdom | 114/270 |

*Primary Examiner*—Stephen M. Johnson
*Attorney, Agent, or Firm*—McGlew and Tuttle, P.C.

[57] ABSTRACT

The invention is directed to an arrangement for protection of active armor against attack by sensor guided armor piercing projectiles, preferably with twin shaped charges, wherein inflatable individual segments are arranged at the object to be protected so as to be pressure- and temperature regulated.

13 Claims, 4 Drawing Sheets

ARRANGEMENT FOR PROTECTION OF ACTIVE ARMOR

Figure 1:
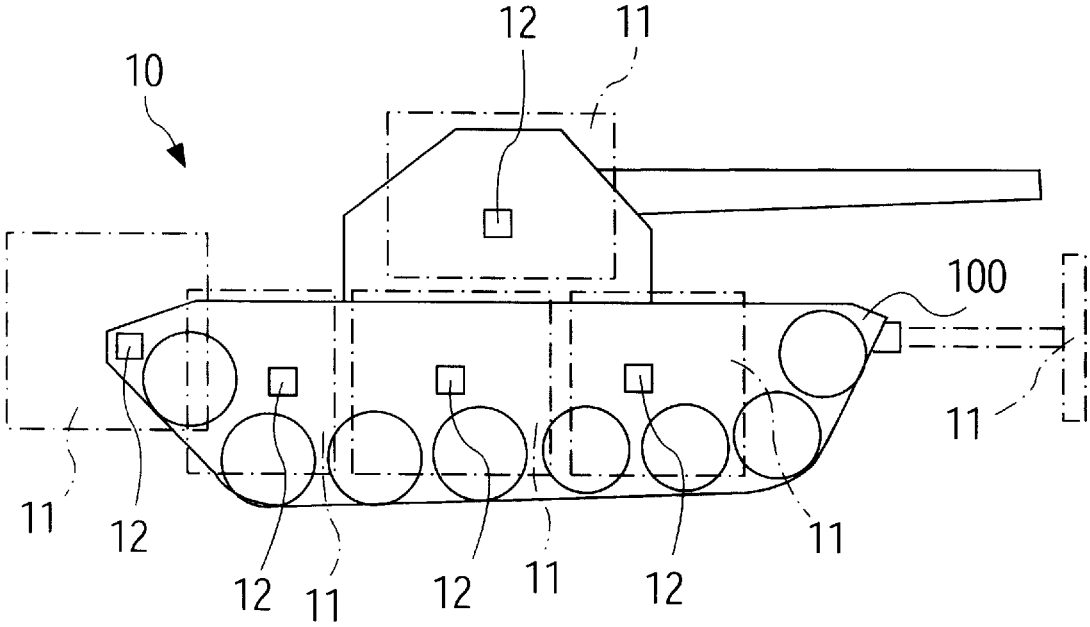

The invention is directed to an arrangement for protection of active armor against attack by sensor controlled armor piercing projectiles according to the preamble of claim 1.

Modern military technology is cognizant of a number of electronic and electro-optical sensors for identification and combatting of targets. Thus, for instance, heat sensitive imaging apparatus are used for target acquisition and sensor controlled missiles for combatting targets. In both these applications the intrinsic radiation emanating from the target or the reflected radiation with active sensors, for instance, radar- or laser sensors, is analyzed, identified as a target signature and utilized for guiding the missile into the target. Therefore, many attempts were made to camouflage the targets and thus to deceive the sensors and to divert them from the target.

A device for camouflaging of stationary objects against reconnaissance by heat sensitive imaging apparatus has become known through the DE-OS 32 17 977; this device covers the object to be camouflaged with a stationary geometrical structure of heat sensitive sensors and thermal energy sources, for instance, in the form of a tent in such a way, that the heat sensitive sensors partially scan the background of the object and the thermal energy sources simulate by means of a regulating device the same temperature distribution as that corresponding to the background of the object on the side facing the hostile heat imaging sensor. This results in the object no longer being distinguishable from the background.

The DE-OS 33 12 169 discloses a decoy target, which is ejected from a container in the form of an inflatable air mattress like hollow member consisting of several chambers. This also does not protect the armored vehicle directly, rather the vehicle throws or rolls the decoy target away from itself, after it has been activated, so as to divert the hostile projectile from itself onto the decoy target.

It is thus the task of the known arrangements, to divert the missile from the target. If this is not successful then these arrangements provide no protection against the warhead of the missile. As a rule such a missile carries a shaped or hollow charge comprising a rod shaped, mechanically stable proximity fuse. The camouflage contrivance at an arbitrary preferably small distance in front of the target is pierced by the missile and only the solid surface of the target, for instance of an armored vehicle, triggers the shaped charge at the optimum distance of approximately three calibers.

In order to achieve an effective protection against this, armored vehicle nowadays carry so-called active armor. As a countermeasure against this, modern anti-tank projectiles are equipped with a twin shaped charge, whereof the first, a so-called initial shaped charge, must already be triggered at a rigorously close tolerance distance of about three to three and one-half meters in front of the target, which only remains possible by a contactless proximity fuse, preferably by a LEM (laser range finder). Protective measures against such projectiles have so far not become known.

The present invention is based upon the task to create an arrangement of the above-mentioned type, which triggers such proximity fuses prematurely and can through this effectively protect active armor against twin shaped charges, and which remains also effective during combat action of longer duration without impairing the mobility of and the vision from the armored vehicle. In addition the camouflage measures which have proved themselves to-date must also remain usable.

Figure 2:
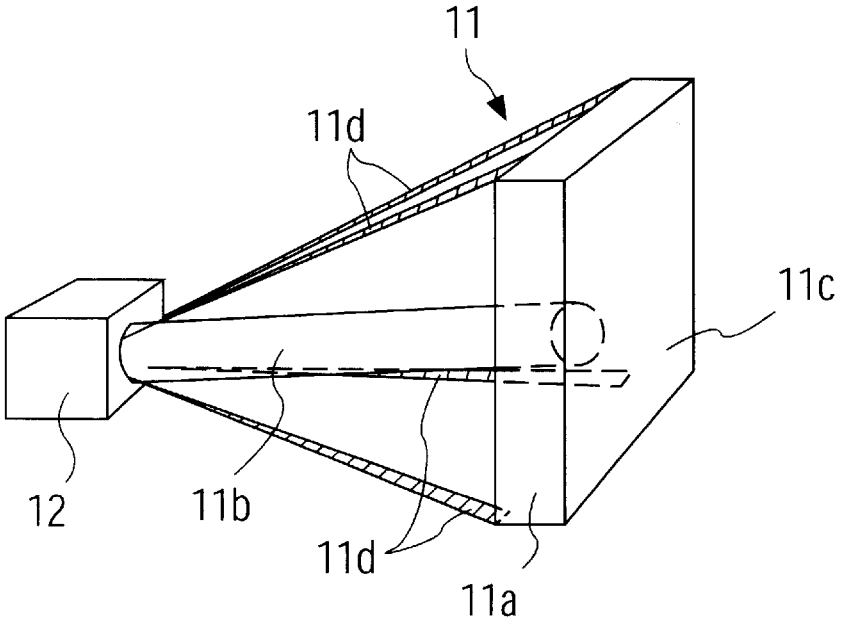
Figure 3:
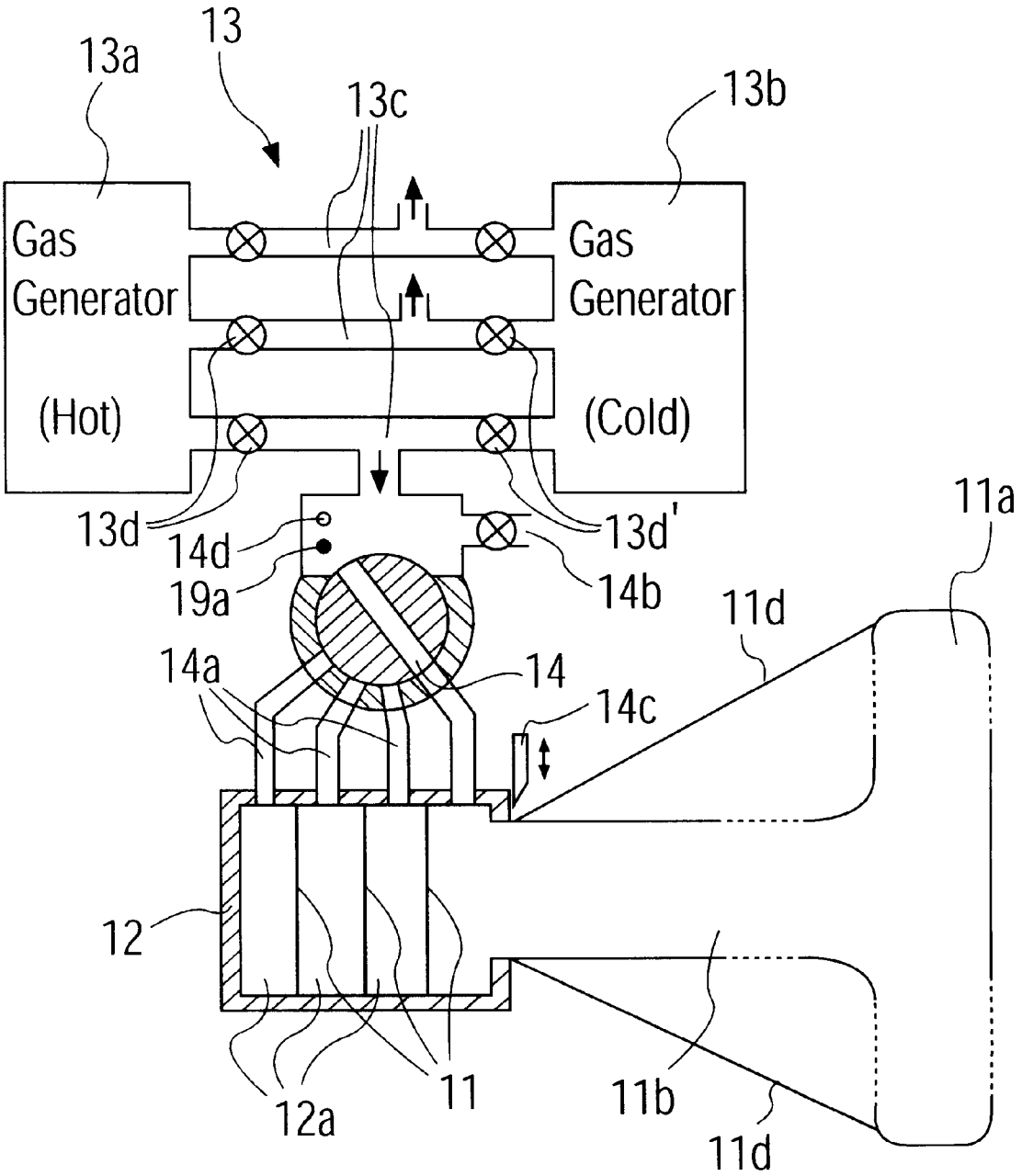
Figure 4:
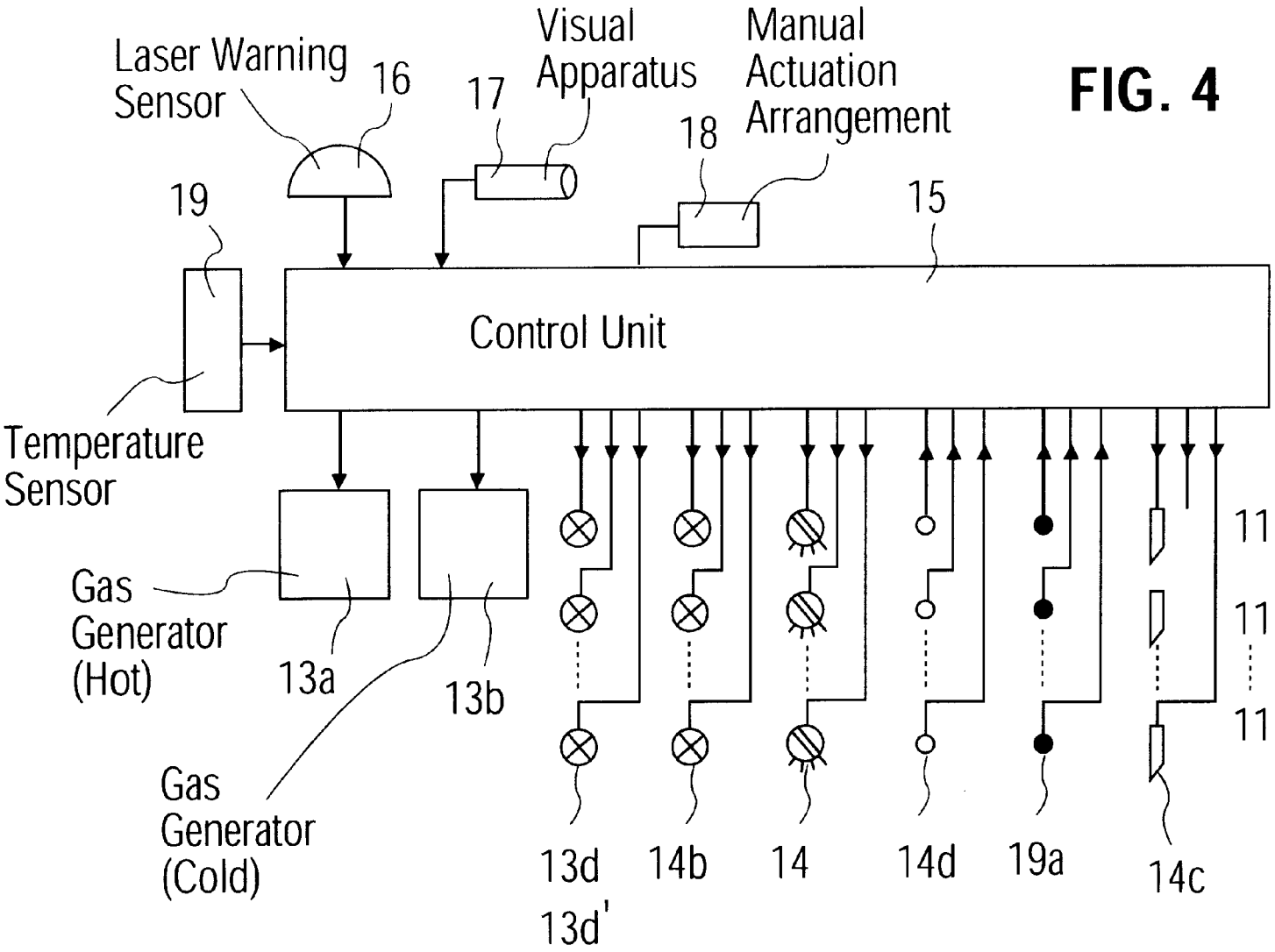
Figure 5:
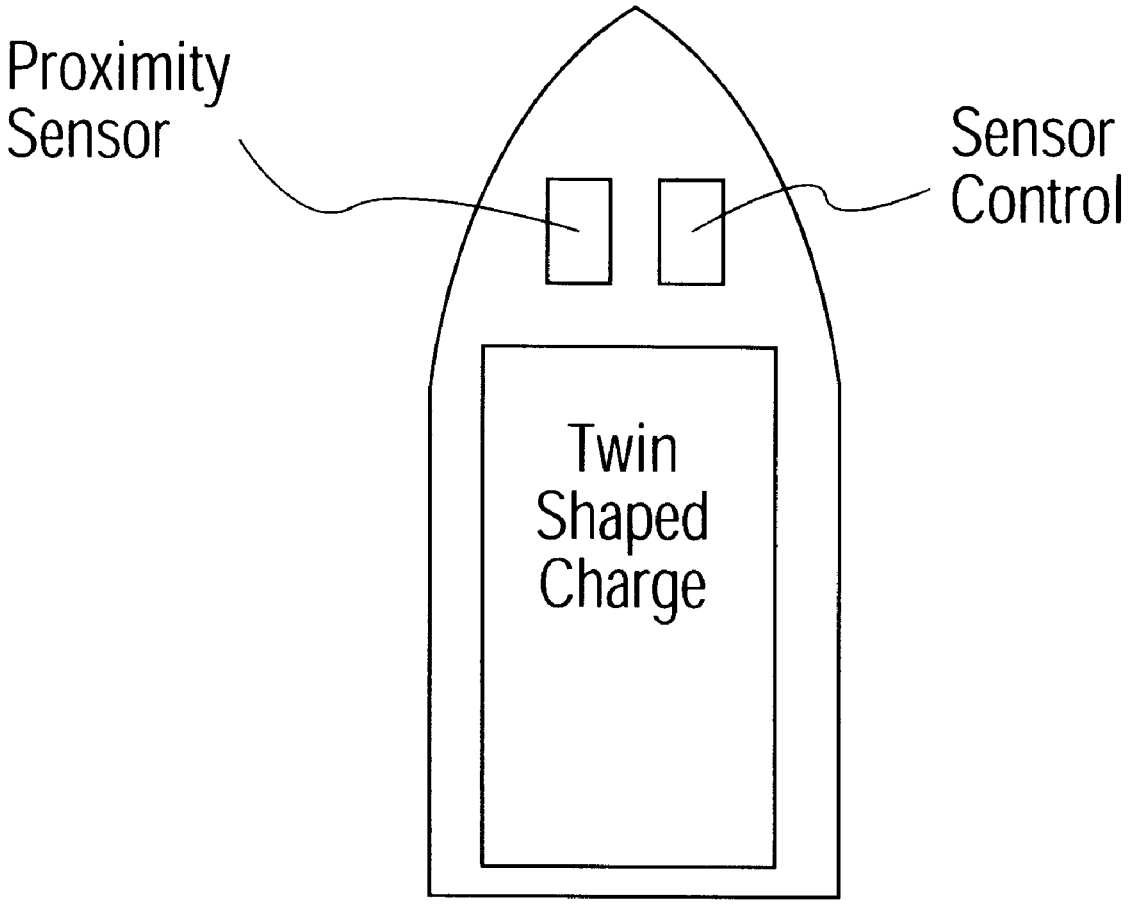

This task is solved by the measures listed in claim 1. Refinements and embodiments are stated in the dependent claims, and embodiment examples are explained in the following description as well as being sketched in the figures in the drawing. It is shown on:

FIG. 1 a diagram of a tank protected by the proposed arrangements,

FIG. 2 a perspective illustration of the arrangement to be designated as a disguising member, FIG. 3 a flow diagram for activating the individual disguising members in diagrammatic presentation, FIG. 4 a block diagram of the control unit and the elements coacting with same in diagrammatic presentation and FIG. 5 is a schematic illustration of a sensor controlled armor piercing projectile with twin shaped charges and proximity sensor.

FIG. 1 shows a tank 100 in diagrammatic illustration, which comprises relatively small housing 12 on its surface at specific spacings and in specific places. In this housing 12 there are arranged one, however preferably several, inflatable foils expanding so as to form an elongated nearly mushroom-shaped individual segment or section 11. These individual segments 11 are conceived as inflatable hollow members and are composed of an elongated stem-like distance portion 11*b* and a shielding portion 11*a* (FIG. 2) having a large area. This shielding portion can preferably be rectangular or square shaped and have an area of one or several square meters. The distance portion 11*b* on the contrary will have a stem-like, round, relatively small cross-section, in return it will however extend over a length of one to three meters away from the tank. As a material a combination of highly elastic rubber-like foil and tear-resistant, non-elastic foil reinforced for instance with Kevlar is proposed, wherein the last named foil forms the shielding portion surface 11*c* as well as the band-like stiffenings 11*d* for mechanical stabilization of the individual segment 11. The distribution of the housings 12 ejecting the individual segments 11 on the tank 100 is preferably chosen in such a way, that the inflated shielding portions 11*a* of all individual segments 11 "conceal" the tank nearly without any gaps, meaning except the vision or aiming devices, and in addition that they stabilize themselves mutually by this arrangement.

In order to fulfill the task of igniting the proximity fuse prematurely, meaning at an effective distance, it suffices to make the shielding part surface 11*c* impermeable and back-scattering or reflecting for the radiation of the active proximity fuse. This occurs by coloration (against laser range finders and other optical sensors) or metalizing (against radar-, inductive and capacitive sensors), wherein both measures are appropriately used in unison. It is however advantageous to additionally camouflage the surface also against spotting sensors. The arrangement in the invention thus protects on the one hand the actively armored target against projectiles with twin shaped charges, note FIG. 5, but on the other hand affords also the previously known camouflage possibilities. The shielding portion surface 11*c* can thus be coated or colored, roughed up, undulated, structured or designed for special purposes. In this case we can use an extremely thin metal layer for simulation of an armored surface or for additional concealment of the tank the signals can be returned by roughed up surfaces, grooves, etc., which signals correspond to those of foliage, grass, etc.

An embodiment example is depicted in FIG. 3, which in addition to a reliable protection against twin shaped charge projectiles also assures an excellent camouflage of a tank. Here foil sector switch 14 with several gas inlet nozzles 14*a* is assigned to the housing 12, in which several foils are arranged consecutively layer-like one behind the other so as to form individual segments 11, wherein this foil sector switch 14 is connected through a system of pipes 13*c* with a gas generation system 13. This gas generator system 13 comprises a hot gas generator 13*a*, which can also use the engine exhaust gases, and a cold gas generator 13*b*. Both are connected through valves 13*d*, 13*d*' and a system of pipes 13*c* with the foil sector switch 14 for direct or mixed supply of the individual segments 11 to be inflated, which supply is regulated by the temperature sensors 19*a* and the pressure sensors 14*d*. This enables to inflate the individual segments 11 with gases of varying temperature to correspond to the environmental conditions, the inherent temperature or other requirements for additional camouflage against infrared sensors. Because of the inflation of the hollow members 10 arranged in the engine region or in the exhaust gas region with cold gas heat imaging apparatus cannot perform an adequate tank identification, etc.

The deception of electro-optical trackers by rapid target signature changes is also possible with the proposed concept, which target signature changes can be achieved by repeated evacuation and renewed filling of the individual segments 11 with gases of different temperature. Sensors registering the shape and size of the target, for instance scanning laser range finders or imaging sensors are also deceived by the considerably altered contour shape and size of the target. If an inflated individual segment 11 is damaged by driving maneuvers or is destroyed according to plan, which among other things, is also sensed by the pressure sensor 14*d*, then the foil selector switch switches immediately to the nearest foil of the new individual segment 11. The gas, regulated by the control unit 15 through the temperature sensors 19, 19*a* in accordance with the environmental- and the filing gas-temperature as well as through the pressure sensor 14*d*, flows into the housing intermediate space 12*a* and assures again immediately the concealment or camouflage of the tank 100. A plurality of variants can be formed herein.

In order to restore the initial situation entirely or partially after termination of the alarm situation, an evacuation valve 14*b* is arranged at the housing 12, through which the excess pressure in the individual segment 11 can be evacuated, so that this segment, assuming use of suitable elastic material- and shape, regains again entirely or partially its initial size. Possible the individual segment 11 is severed by the assigned cut-off device 14*c*. These measures assure the almost complete mobility of the tank also in obstructive terrain as well as the adaptability of the protective device to the threat environment.

FIG. 4 represents a sketch of an embodiment example of a switching- and control arrangement. A control unit 15 regulates the supply of the individual segments 11 through the valve 13*d*, 13*d*' of the piping system 13*c* and the foil sector switch 14. For this purpose the control arrangement receives the required activation signals for instance from a laser warning sensor 16 or from visual apparatus 17 etc. A manual actuation arrangement 18 is also assigned to this control unit 15 and additionally one or several temperature sensors 19 as well as pressure sensor 14*d*. Finally, an evacuation valve 14*b* and the severance devices 14*c* are also actuated by the control unit 15.

Thus an arrangement is created which protects vehicles with active armor effectively against projectiles comprising twin shaped charges and in addition affords proven camouflage possibilities without impairing the mobility of the vehicle.

What is claimed is:

1. Arrangement for protecting an active armored object having an exterior surface against attack by sensor controlled armor piercing projectiles with twin shaped charges and proximity sensor comprising inflatable hollow members mounted on the exterior surface of said object in spaced relation and forming at least one of decoy targets and concealment means, wherein the improvement comprises that said hollow members (10) include a plurality of individual sections (11) located within a housing (12), means connected to said housing for inflating said individual sections with gases at different temperatures for forming a "screening mushroom" projecting outwardly from the exterior surface of said object, said individual sections are arranged in series within said housing one following the other so that said individual sections are inflated one at a time, said individual sections each comprise an inflatable foil forming a shielding portion (11*a*) and a distance portion (11*b*) extending outwardly from the exterior surface of said object and located behind said shielding portion, said inflating means comprises a gas generation system connected to said housing, an evacuation valve connected to said individual sections for evacuating an inflated said individual section, and a cut-off device associated with said housing for cutting off said individual section from said housing following inflation.

2. Arrangement according to claim 1, characterized in that the shielding portions (11*a*) are one of rectangular and square shaped and the housings (12) are arranged in such a way, that the inflated shielding portions (11*a*) of all the housings (12) cover the object (100) and are arranged in closely spaced relation.

3. Arrangement according to claim 1, wherein the shielding portion (11*a*) has a surface (11*c*) spaced and facing outwardly from the object and the surface is at least one of coated, colored, metalized and structured.

4. Arrangement according to claim 3, wherein each said individual section (11) is mechanically stabilized by band-like stiffeners (11*d*).

5. Arrangement according to claim 4, wherein said individual sections (11) comprise a combination of highly elastic rubber-like foil and tear resistant foil reinforced with Kevlar, and said reinforced foil forms portion surface (11*c*) and the band-like stiffeners (11*d*).

6. Arrangement according to claim 1, wherein a plurality of the inflatable foils of said individual segments (11) are arranged in each of the housings (12) with each of the individual segments forming an intermediate space (12*a*) separated from one another and that a gas inlet nozzle (14*a*) of the gas generation system (13) discharges into each of the intermediate spaces (12*a*).

7. Arrangement according to claim 1, wherein the gas generation system (13) comprises a hot gas generator (13*a*) and a cold gas generator (13*b*) and both are connected by controllable valves (13*d*), (13*d*) with a common piping system (13*c*).

8. Arrangement according to claim 7, wherein the controllable valves (13*d*) and a piping system (13*c*) are assigned to each said individual sections (11), and the piping system discharges into a foil selector switch (14) of the individual sections (11).

9. Arrangement according to claim 8 wherein the gas generation system (13), including the foil selector switch (14), the evacuation valve (14*b*) and the cut-off device (14*c*), are activated by an electronic control unit (15) in accordance with signals of at least one of a laser warning sensor (16) and a visual apparatus (17).

10. Arrangement according to claim 9, wherein a manual switching and control unit (18) are assigned to the control unit (15).

11. Arrangement according to claim 9, wherein temperature sensors (18, 19*a*) for an immediate environment and for the gas generation system (13) are assigned to the control unit (15).

12. Arrangement according to claim 9, wherein pressure probes 14*d* for the gas generation system 13 are assigned to the control unit 15.

13. Arrangement according to claim 1, wherein the distance portion 11*b* can be elongated up to a distance of three meters.

* * * * *

UNITED STATES PATENT AND TRADEMARK OFFICE

CERTIFICATE OF CORRECTION

PATENT NO. : 6,128,999 B1
DATED : January 12, 2001
INVENTOR(S) : Sepp et al.

It is certified that error appears in the above-identified patent and that said Letters Patent is hereby corrected as shown below:

[73] Assignee: LFK-Lenkflugkoerpersysteme GmbH, Munich, Germany

Signed and Sealed this

Twenty-first Day of August, 2001

*Attest:*

Nicholas P. Godici

*Attesting Officer*

NICHOLAS P. GODICI
*Acting Director of the United States Patent and Trademark Office*